US008033923B2

(12) United States Patent
Chung

(10) Patent No.: US 8,033,923 B2
(45) Date of Patent: Oct. 11, 2011

(54) LOCKING MECHANISM FOR A CONVERTIBLE GAME TABLE

(75) Inventor: Safari Chung, Taipei (TW)

(73) Assignee: Indian Industries, Inc., Evansville, IN (US)

( * ) Notice: Subject to any disclaimer, the term of this patent is extended or adjusted under 35 U.S.C. 154(b) by 43 days.

(21) Appl. No.: 12/475,976

(22) Filed: Jun. 1, 2009

(65) Prior Publication Data

US 2009/0305801 A1 Dec. 10, 2009

Related U.S. Application Data

(60) Provisional application No. 61/059,125, filed on Jun. 5, 2008.

(51) Int. Cl.
*A63D 15/64* (2006.01)
*A63D 15/00* (2006.01)

(52) U.S. Cl. ..... 473/14; 473/10; 473/9; 473/15

(58) Field of Classification Search ..... 473/1, 4, 473/9, 10, 14–16, 18
See application file for complete search history.

(56) References Cited

U.S. PATENT DOCUMENTS

| | | | | | |
|---|---|---|---|---|---|
| 139,425 | A | | 5/1873 | Schindler | |
| 653,727 | A | * | 7/1900 | Zentner | 473/9 |
| 747,097 | A | | 12/1903 | Spalt | |
| 747,726 | A | * | 12/1903 | Karhan | 473/9 |
| 884,605 | A | | 4/1908 | McEvoy | |
| 1,070,592 | A | * | 8/1913 | Fay | 473/8 |
| 1,410,171 | A | * | 3/1922 | Davis | 473/10 |
| 1,979,177 | A | | 10/1934 | Staff | |
| 4,004,804 | A | | 1/1977 | Gholson | |
| 4,063,728 | A | | 12/1977 | Zemanek | |
| D247,127 | S | * | 1/1978 | Kavka | D21/318 |
| 4,070,025 | A | | 1/1978 | Wiser | |
| 4,089,526 | A | | 5/1978 | Olving | |
| 4,160,550 | A | | 7/1979 | Barrett | |
| 4,216,963 | A | | 8/1980 | Boucher | |
| 4,251,072 | A | | 2/1981 | Anthony | |
| 4,257,600 | A | | 3/1981 | Goldfarb | |
| 4,305,581 | A | * | 12/1981 | Neuharth | 473/15 |

(Continued)

OTHER PUBLICATIONS

Sears website pages advertizing rotating game tables, http://www.sears.com/shc/s/search_10153_12605?keyword=multi-game+tables.x=0&gobotton-find.

*Primary Examiner* — Mitra Aryanpour
(74) *Attorney, Agent, or Firm* — Woodard, Emhardt, Moriarty, McNett & Henry LLP

(57) ABSTRACT

A game table assembly comprises a game table having opposing first and second game playing surfaces, with the game table being rotatable to orient a desired one of the game playing surfaces facing upward. The game table assembly includes opposing and non-rotatable end sections positioned adjacent the width ends of the game table and a cross member engaged with and extending between the end sections, with the game table being rotatable about the cross member. The game table assembly further includes at least one corner bracket pivotally mounted to either the corresponding end section or the game table such that the corner bracket may be horizontally pivoted into and out of selective locking engagement to prevent rotation of the game table and thereby selectively lock the game table in the desired orientation with the desired one of the game playing surfaces facing upward.

14 Claims, 3 Drawing Sheets

U.S. PATENT DOCUMENTS

| | | | | |
|---|---|---|---|---|
| 4,330,776 | A | 5/1982 | Dennison et al. | |
| 4,365,803 | A * | 12/1982 | Barnes et al. | 473/14 |
| 4,519,607 | A | 5/1985 | Schill | |
| 4,927,140 | A | 5/1990 | Pappas | |
| 5,026,053 | A | 6/1991 | Paterson et al. | |
| 5,607,155 | A | 3/1997 | Campbell | |
| 5,746,660 | A | 5/1998 | Grover | |
| 5,752,886 | A | 5/1998 | Tien | |
| 6,082,736 | A | 7/2000 | Barlow | |
| 6,109,607 | A | 8/2000 | Cartwright et al. | |
| 6,155,564 | A * | 12/2000 | Tsai | 273/108.1 |
| 6,347,797 | B1 * | 2/2002 | Tsai | 273/309 |
| 6,349,939 | B1 | 2/2002 | Tsai | |
| 6,419,224 | B1 | 7/2002 | Tsai | |
| 6,502,819 | B2 | 1/2003 | Rieber et al. | |
| 6,616,141 | B2 | 9/2003 | Diamant | |
| 6,764,409 | B1 | 7/2004 | Voden | |
| 6,780,117 | B1 | 8/2004 | Osborne | |
| 6,926,278 | B2 * | 8/2005 | Bibi | 273/284 |
| D537,888 | S * | 3/2007 | Boettcher | D21/397 |
| 7,523,942 | B2 | 4/2009 | Chung | |
| 2004/0132536 | A1 | 7/2004 | Voden | |
| 2004/0132537 | A1 | 7/2004 | Voden | |
| 2005/0049056 | A1 * | 3/2005 | Padilla | 473/10 |
| 2005/0064945 | A1 | 3/2005 | Voden | |
| 2005/0107177 | A1 | 5/2005 | Arias | |
| 2005/0250589 | A1 | 11/2005 | Voden | |
| 2007/0155519 | A1 * | 7/2007 | Panzica | 473/1 |

* cited by examiner

LOCKING MECHANISM FOR A CONVERTIBLE GAME TABLE

CROSS-REFERENCE TO RELATED APPLICATIONS

This application claims the benefit of U.S. Provisional Application No. 61/059,125, filed Jun. 5, 2008, which is hereby incorporated by reference.

FIELD OF THE DISCLOSURE

The present disclosure relates to game tables, and in particular a locking mechanism for a convertible game table.

BACKGROUND OF THE DISCLOSURE

Watching and participating in sporting events and games is a popular pastime for many people. However, due to time, space and the number of people needed for most such games, it is not always practical to arrange a full-scale game at any particular time. Moreover, due to the skill and physical conditioning required, plus the potential injuries from many such games, individuals are not always prepared to participate in a full-scale game. Other factors such as weather have also been known to make arranging games difficult. Accordingly, there has developed a need and market for indoor or smaller scale games, including recreational game tables such as for table soccer (sometimes called foosball), air hockey or field hockey, which can be played with less room and require fewer people. Game tables allow the participants to simulate a full-sized game with fewer people, less space and in a protected environment. Additionally, game tables for playing other popular pastime games such as billiards are in demand. The game tables, for example, can be set up in basements, garages, game rooms, backyards, gyms, party facilities or otherwise and are often played with two or four people.

Additionally, it may be desirable to convert between at least two games within one multi-game table assembly. Improved systems and assemblies for playing and converting between table games are desired.

SUMMARY OF THE DISCLOSURE

In certain embodiments, a game table assembly comprises a rotatable game table having opposing longitudinal sides defining a length along a length axis and opposing width ends defining a width along a width axis. The game table includes a first game playing surface for playing a first game and an opposite second game playing surface for playing a second game, with the game table being rotatable to orient a desired one of the game playing surfaces facing upward. The game table assembly includes opposing and non-rotatable end sections positioned adjacent the width ends and a cross member engaged with and extending between the end sections. The cross member extends through the game table along the length axis such that the game table is rotatable about the cross member to rotate between orientating the first and second game playing surfaces upward. The game table assembly further includes at least one corner bracket configured to selectively lock the game table in the desired orientation with the desired one of the game playing surfaces facing upward. The at least one corner bracket is pivotally mounted to either the corresponding end section or the game table so that the corner bracket may be horizontally pivoted into and out of selective locking engagement to prevent rotation of the game table.

In certain other embodiments, a game table assembly comprises a game table assembly having a rotatable table bed, the table bed being rectangular in shape and having four corners, opposing longitudinal sides defining a length along a length axis, and opposing width ends defining a width along a width axis. The table bed includes a first game playing surface for playing a first game and an opposite second game playing surface for playing a second game, wherein the table bed is rotatable about the length axis to rotate between the first and second game playing surfaces to orient the desired one of the game playing surfaces facing upward. The game table assembly includes stationary end sections positioned adjacent the width ends, wherein the table bed is rotatably engaged with and positioned between the end sections. Additionally, the game table assembly includes four L-shaped corner brackets pivotally engaged with the end sections and selectively lockable to the table bed adjacent the four corners to selectively lock the table bed in the desired orientation with the desired one of the game playing surfaces facing upward and prevent rotation of the table bed.

In certain other embodiments, a game table assembly comprises a rotatable game table having opposing longitudinal sides defining a length along a length axis and opposing width ends defining a width along a width axis. The game table includes a first game playing surface for playing a first game and an opposite second game playing surface for playing a second game. The game table is rotatable about the length axis to rotate between the first and second game playing surfaces to orient the desired one of the game playing surfaces facing upward. Additionally, the game table includes a frame having first and second portions extending along at least a portion of the perimeter of the first and second game playing surfaces, respectively, and extending at least slightly beyond the first and second game playing surfaces, respectively, to prevent escape of game playing pieces from the game playing surfaces. The frame also includes a side railing portion positioned between the first and second portions. The game table assembly further includes opposing and non-rotatable end sections positioned adjacent the width ends, the game table being positioned between and rotatably engaged with the end sections. Additionally, the game table assembly includes at least one corner bracket extending between one of the end sections and the game table. The bracket is selectively positionable against the side railing portion along one of the longitudinal sides and selectively lockable thereto to lock the game table in the desired orientation with the desired one of the game playing surfaces facing upward and to prevent rotation of the game table.

DESCRIPTION OF THE ILLUSTRATED EMBODIMENTS

Figure 1:
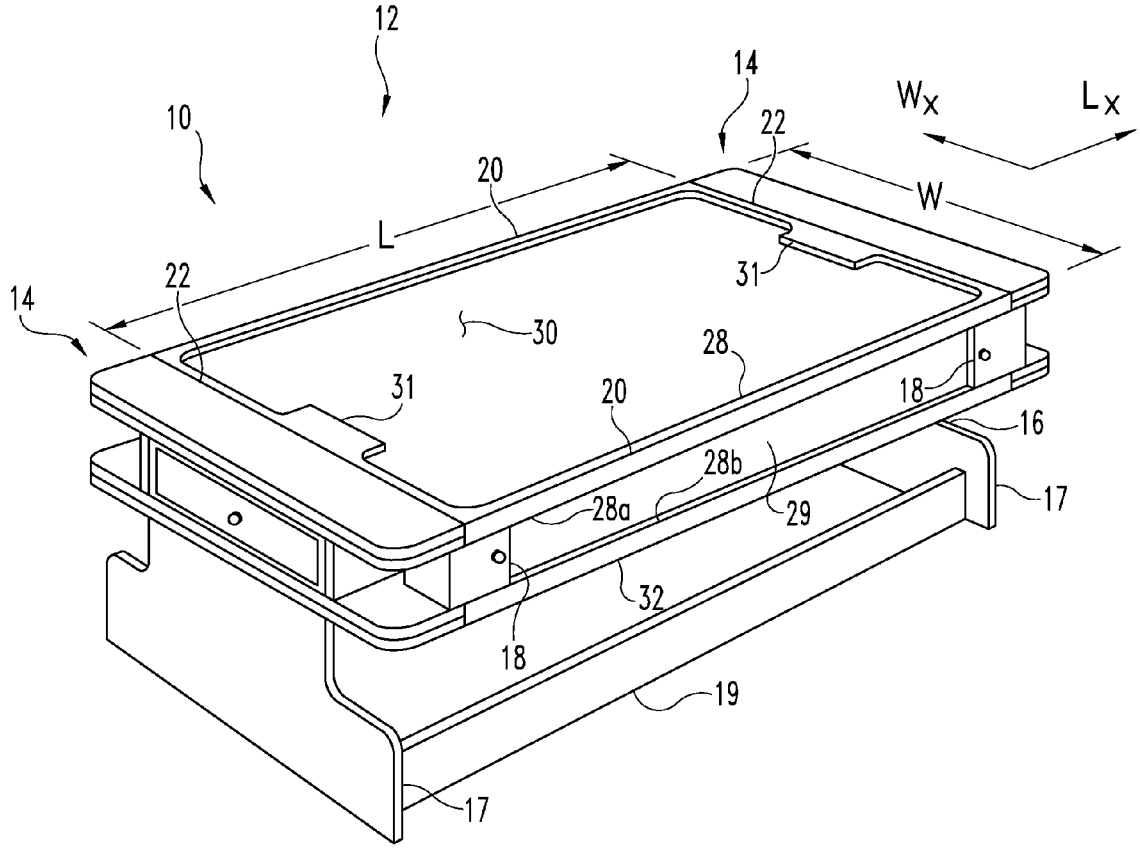
FIG. 1 is a perspective view of a game table assembly according to an embodiment of the present disclosure.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein are contemplated as would normally occur to one skilled in the art to which the disclosure relates.

In certain embodiments of the present disclosure, a locking mechanism for a convertible game table is provided. The game table is convertible between at least two table games, examples including air hockey, billiards, table soccer (also known as foosball), and table tennis. In certain embodiments, the game table includes a table bed or center game-playing section having top and bottom game playing surfaces. The center game-playing section can be flipped so that the desired game-playing surface is facing up and exposed to the players. The game table includes at least one locking bracket to selectively lock the center game-playing section in the desired orientation.

A standard game table includes a playing surface, held over a support surface, such as a floor, by a support structure such as one or more legs or pedestals. The playing surface is often rectangular or round, but may be made in various geometric shapes. The playing surface is also typically substantially flat. In many instances, the playing surface is surrounded by a peripheral rail or raised portions of the game table, which typically functions to retain game pieces within the area of the playing surface. The game pieces of the present disclosure are usable with various types of games and/or game tables, which are considered conventional for purposes of the present disclosure and are not described herein in detail.

FIG. 1 illustrates a convertible game table assembly 10 according to one embodiment of the present disclosure. Game table assembly 10 generally includes a center table bed or game table or game-playing section 12 (hereinafter referred to as "center section 12," "center game-playing section 12," and/or "section 12"), two opposing end sections 14, a base 16, four corner locking brackets 18 extending between end sections 14 and center section 12, and a pivot member such as a center rod 19 (see FIG. 2) extending between sections 14 and through the center of section 12 about which section 12 rotates. In the illustrated embodiment, base 16 includes two opposing legs 17 and two opposing cross-bars 19 which together support sections 12 and 14. Alternately, the assembly 10 can be supported in other manners, such as through the use of four corner legs, with base 16 being only one example of numerous possible support configurations.

As illustrated, center game-playing section 12 is rectangular in shape and has 4 corners. Additionally, the section 12 has a length L and opposing longitudinal sides 20 extending along a length axis $L_x$ and a width W and opposing width or player ends 22 extending along a width axis $W_x$ Center game-playing section 12 includes a first game-playing surface 30 and an opposing second game-playing surface 32. Section 12 can be flipped or inverted or rotated about the center rod 19 extending along the length axis $L_x$ to expose either game-playing surface 30 or 32 depending on which game the players desire to play. In this way, center section 12 is rotatable with respect to the non-rotating or stationary end sections 14 positioned adjacent the player ends 22. When section 12 is orientated with the desired game-playing surface facing up and exposed to the players, section 12 may be selectively locked in position with respect to end sections 14 via locking brackets 18.

In certain embodiments, section 12 includes a frame 28 which surrounds and extends above game-playing surfaces 30 and 32 a height sufficient to block escape of a playing piece from the respective playing surface. In the illustrated embodiment, frame 28 includes first and second portions 28*a* and 28*b* which extend above surfaces 30 and 32, respectively. Portions 28*a* and 28*b* of the frame can extend upward a sufficient height as would occur to one skilled in the art, as a design choice for a particular game. Frame 28 includes opposing center side rails 29 which, in certain embodiments, may be inset horizontally inward from portions 28*a* and 28*b* of the frame. Alternately, center side rails 29 can be flush with frame portions 28*a* and 28*b*, creating a flat side edge. In yet other embodiments, center side rails 29 may define depressions at the ends thereof which are sized and configured to receive portions or legs of brackets 18, such that the brackets are positioned flush with the remainder of the frame creating a smooth, flat appearance along the sides of the table. Frame 28 can be a standard frame made of metal, wood, laminate, particleboard, MDF or plastic. As stated above, the illustrated section 12 is rectangular in shape defining rectangular game-playing surfaces, however it should be appreciated that section 12 and the corresponding game-playing surfaces can include various shapes as would generally occur to one skilled in the art, including circular, square, or polygonal as examples.

Game-playing surfaces 30 and 32 are configured to be integral with or mounted to frame 28 and each be supported underneath by appropriate support members. Surfaces 30 and 32 extend across the area defined within frame 28 to form the playing areas. In certain embodiments, the game-playing surfaces are mounted to the frame or extend to inner edges of the frame to eliminate gaps. The game-playing surfaces may be attached using standard methods such as adhesive, friction, screws, bolts or other permanent or removable connectors. The game-playing surfaces may be appropriately sized and configured for the desired games. Additionally, the game-playing surfaces may be appropriately shaped pieces of material configured to be mounted onto support members of the frame. In certain embodiments, game-playing surface 30 is configured for playing a different table game than surface 32. Example table games which could be played on surface 30 or surface 32 include air hockey, billiards, table soccer (also known as foosball), and table tennis. In an example embodiment, surface 30 may be an air hockey game-playing surface having air forced through holes in the surface, with opposing goals 31 associated with the frame and configured for passage of a hockey puck, and surface 32 may be a billiards game-playing surface with a plurality of pockets and bumpers associated with the frame.

Figure 2:
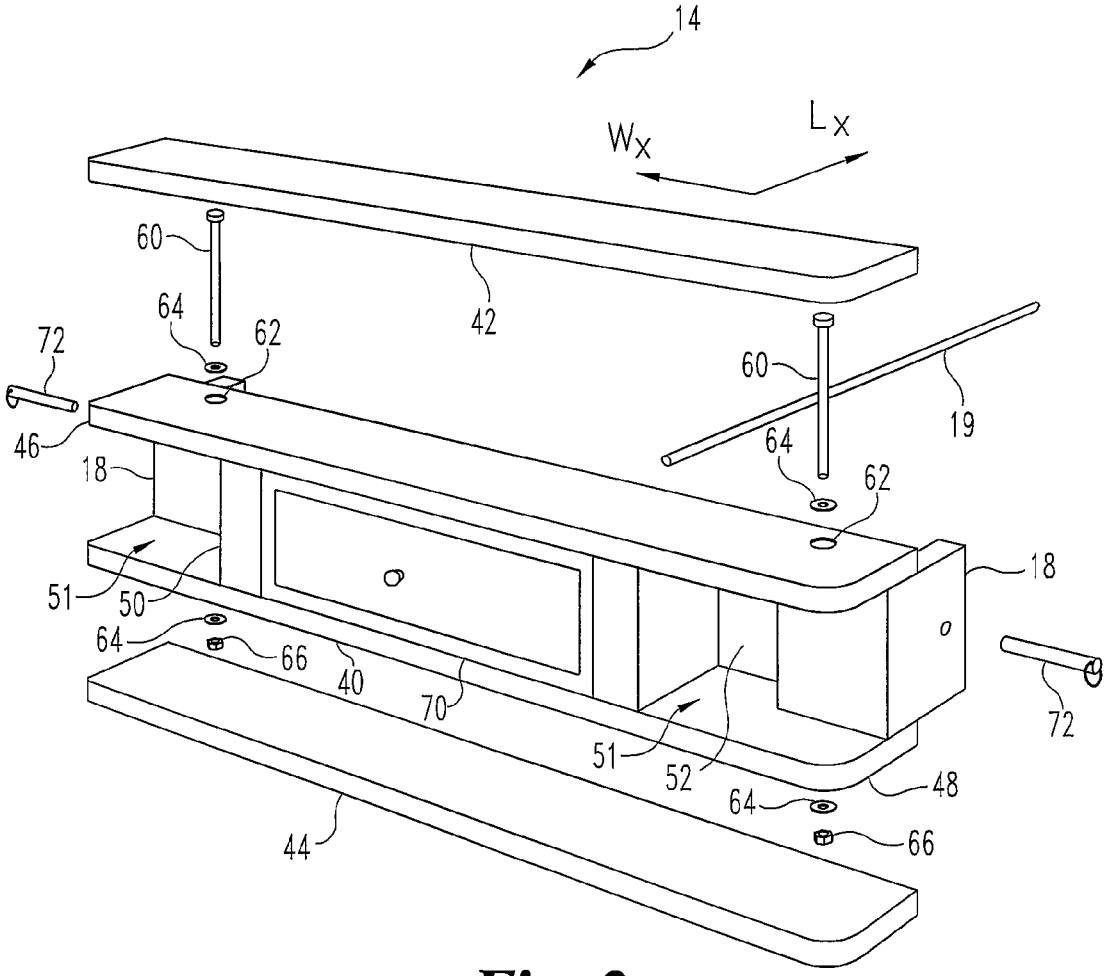
FIG. 2 is an exploded, perspective view of components of the game table assembly according to the embodiment of FIG. 1.

According to the example embodiment illustrated in FIG. 2, each end section 14 may include a middle piece 40 sandwiched between a top plate 42 and a bottom plate 44. The illustrated middle piece 40 generally includes a top section or portion 46, a bottom section or portion 48, a center section or portion 50 and a back section or portion 52. The portions of middle piece 40 define side cut outs or cavities 51, with center portion 50 positioned between the cavities. Middle piece 40 may also optionally include a drawer or cabinet 70 within center portion 50 to hold game pieces and/or other various table game accessories. It should be appreciated that top and bottom plates 42 and 44 may be mounted to middle piece 40 in various appropriate manners as would generally occur to one skilled in the art. Additionally, it should be appreciated that end pieces 14 may be attached to legs 17 of base 16 in various appropriate manners as would generally occur to one skilled in the art.

In the illustrated embodiment, brackets 18 are mounted to pivot horizontally with respect to middle piece 40 via pivot pins 60. As such, top and bottom plates 42 and 44 define holes 62 configured for passage of pivot pins 60. In certain embodiments, assembly 10 can also include washers 64 and locking nuts 66 to secure pivot pins 60 with respect to middle piece 40. As illustrated, portions of brackets 18 may be positioned within cavities 51 and, in a locking orientation, positioned substantially flush against back portion 52 between top and bottom portions 46 and 48. The illustrated brackets 18 are configured to pivot with respect to middle piece 40 about a pivot axis defined by pivot pin 60. In certain embodiments, there are four brackets 18 positioned at the corners of assembly 10. Alternately, less than four brackets can be used with assembly 10 to lock center portion 12 at the desired orientation.

Locking pins 72 may be used to secure brackets 18 to center portion 12 to selectively lock the game table with the desired game-playing surface facing up. As illustrated, portions of brackets 18 may be positioned against the center side railing 29 and selectively locked thereto. In certain embodiments, locking pins 72 may be cotter pins to inhibit removal of the pins. However, it should be appreciated that locking pins 72 are only one example of the numerous possible locking pieces which could be used to lock bracket 18 to center section 12. As an alternative example, the locking piece could be a rod attached to and extending out from center section 12 and the bracket 18 could define a corresponding slot to receive the rod as the bracket pivots into the locked position.

Figure 3:
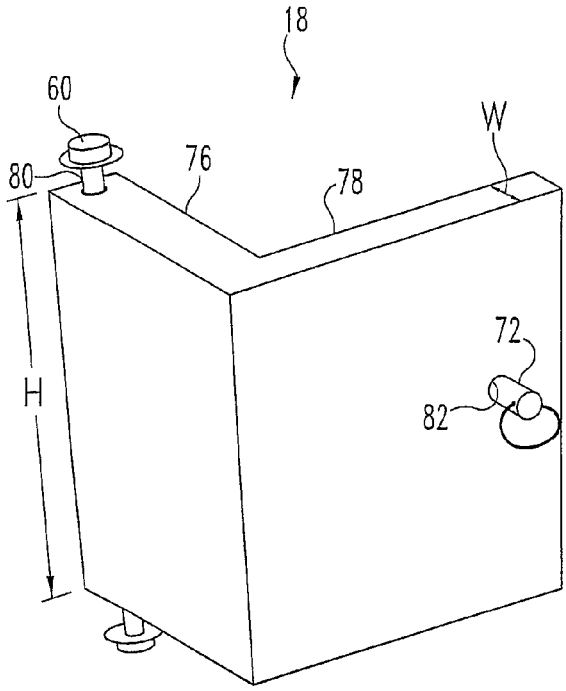
FIG. 3 is a perspective view of a bracket component of the game table assembly according to the embodiment of FIG. 1.
Figure 4:
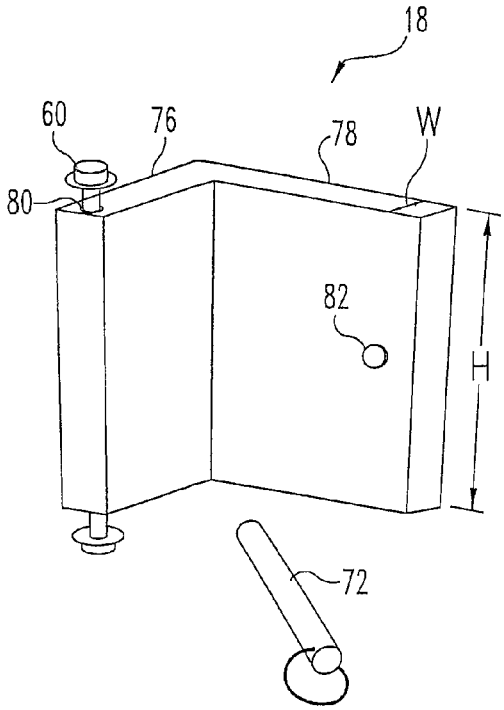
FIG. 4 is a perspective view of a bracket component of the game table assembly according to the embodiment of FIG. 1.

FIGS. 3 and 4 provide close-up perspective views of a bracket 18 according to one embodiment of the present disclosure. Brackets are used with assembly 10 as the engaging mechanism to substantially prevent rotational movement of center section 12 and preferably lock section 12 in a position with the desired game-playing surface facing upward and exposed to the players. In the illustrated embodiment, each bracket 18 is a rigid, L-shaped member with a first leg section 76 and a second leg section 78 angled approximately 90 degrees from the first section. First section 76 defines a first hole 80 configured to receive pivot pin 60 and second section 78 defines a second hole 82 configured to receive locking pin 72.

In certain embodiments, sections 76 are positioned within cavities 51 adjacent back portions 52 of middle pieces 40 and snugly fit between top and bottom portions 46 and 48, preventing unwanted vertical movement of bracket 18. Additionally, the illustrated brackets 18 are configured so that sections 78 are positioned to engage side rails 29 of frame 28 between portions 28*a* and 28*b*. In a particular embodiment, each section 78 may be received in a cavity or depression in side rail 29 having a height and width substantially equal to or slightly larger than the height and width of the section 78. In alternative embodiments, middle pieces 40 could be solid pieces with slots defined therein and configured to slidably and snugly receive first sections 76 so that the locking brackets slide into place to lock center section 12 and do not pivot with respect to end piece 14.

The brackets used with assembly 10 preferably nest into a locked position by fitting snugly into corresponding locations in end piece 14 and/or center section 12. In a locked or closed position, the interaction between the brackets, end pieces 14 and center section 12 preferably provides a stable center section, minimizing potential movement. In the illustrated embodiment, first leg sections 76 snugly fit within cavities 51 defined in middle piece 40 between top and bottom portions 46 and 48. Additionally, second leg sections 78 span the gap between the end piece and center section and rail and snugly fit into a cavity in the center section, for example, between portions 28*a* and 28*b* of frame 28. In certain embodiments, the distance between top and bottom portions 46 and 48 and the distance between portions 28*a* and 28*b* of frame 28 is substantially equal to or at most slightly larger than the height H of locking brackets 18 to allow a snug fit between the pieces. In one embodiment, side rails 29 define cavities or depressions at the ends thereof which are configured to receive second leg sections 78 of brackets 18, where the cavities have a depth equal to the thickness or width W of leg sections 78. In this embodiment, the brackets lie flush with the remainder of the side rails when locked, providing a flush engagement and smooth appearance to the sides of assembly 10.

A bracket 18 can be selectively closed by being moved to engage the middle section and an end section, and optionally locked in place by inserting a locking pin 72 through a hole 82 and into a corresponding hole (not shown) in a side rail 29. When a user desires to flip or invert or rotate center section 12 to expose the opposite game-playing surface, the user can remove locking pins 72, disengage or open brackets 18 away from center section 12 and flip the center section as desired. Brackets 18 can then be closed to selectively hold center section 12 at the new desired orientation and locked by inserting locking pins 72 through holes 82 and into corresponding holes in frame 28. Locking center section 12 at the desired orientation provides increased stability to assembly 10 and substantially prevents unwanted movement of the section, especially undesired rotational movement of section 12.

It should be appreciated that the bracket used to hold center section 12 at the desired orientation could be configured differently, with the illustrated locking bracket 18 being only one example of numerous possible locking pieces. For example, the bracket mounting could be reversed to be pivotably mounted on the center section and rotated into engagement with an end section. As an alternative example, rather than being L-shaped, the locking bracket could be substantially straight and extend between respective nests in the center section and the end piece, with the end piece having a side wall aligned with side rail 29 of frame 28. In an alternate embodiment, a "U" shaped bracket is used with side legs which slide into corresponding slots in an end piece and the center piece, and a center/lower leg of the "U" spans the gap between the end piece and center piece.

Game table assembly 10 can be manufactured and assembled from standard materials. For example, the components may be wood, plastic or metal such as aluminum or steel. The game pieces used in connection with game table assembly 10 may be standard or reduced sized. In certain embodiments, game table assembly 10 may be portable and/or disassemblable. Additionally, in certain embodiments, game table assembly 10 may be manufactured to include modular, lightweight components to enhance the ease of transport, assembly and disassembly.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What is claimed is:

1. A game table assembly, comprising:

a rotatable game table having opposing longitudinal sides defining a length along a length axis and opposing width ends defining a width along a width axis, wherein the game table includes a first game playing surface for playing a first game and an opposite second game playing surface for playing a second game, with the game table being rotatable to orient a desired one of the game playing surfaces facing upward;

opposing and non-rotatable end sections positioned adjacent the width ends;

a cross member engaged with and extending between the end sections, the cross member extending through the game table along the length axis and the game table being rotatable about the cross member to rotate between orientating the first and second game playing surfaces upward; and at least one corner bracket configured to selectively lock the game table in the desired orientation with the desired one of the game playing surfaces facing upward, wherein the at least one corner bracket is pivotally mounted to either the corresponding end section or the game table such that the corner bracket may be horizontally pivoted into and out of selective locking engagement to prevent rotation of the game table;

wherein the at least one corner bracket is L-shaped having first and second legs, the first leg being pivotally mounted to an end section and the second leg being selectively engageable with the game table;

wherein the game table includes a frame having first and second portions extending around the perimeter of the first and second game playing surfaces, respectively, and extending at least slightly beyond the first and second game playing surfaces, respectively, to prevent escape of game playing pieces from the game playing surfaces, wherein the frame includes a center side railing positioned between and inset horizontally inward from the first and second portions, wherein the second leg of the bracket is configured to be positioned adjacent the center side railing along one of the longitudinal sides snugly between the first and second portions when the second leg is engaged with the game table.

2. The game table assembly of claim 1, wherein the game table is rectangular in shape having four corners and the at least one corner bracket includes four corner brackets pivotally mounted to the end sections adjacent the four corners of the game table, wherein each of the brackets may be horizontally pivoted into and out of selective locking engagement with the game table to prevent rotation of the game table.

3. The game table assembly of claim 1, wherein the end section defines a cavity configured to receive the first leg of the corner bracket and the cavity allows for horizontal pivoting of the bracket within the cavity.

4. The game table assembly of claim 1, wherein the corresponding end section includes spaced apart top and bottom portions and a back portion extending between the top and bottom portions, wherein the first leg of the corner bracket is configured to be positioned against the back portion snugly between the top and bottom portions when the second leg is engaged with the game table.

5. The game table assembly of claim 1, further comprising a locking pin operable to selectively lock the at least one corner bracket to the game table in the engaged position, wherein the corner bracket defines a hole configured to receive the locking pin.

6. A game table assembly, comprising:

a game table assembly having a rotatable table bed, the table bed being rectangular in shape and having four corners, opposing longitudinal sides defining a length along a length axis, and opposing width ends defining a width along a width axis, wherein the table bed includes a first game playing surface for playing a first game and an opposite second game playing surface for playing a second game, wherein the table bed is rotatable about the length axis to rotate between the first and second game playing surfaces to orient the desired one of the game playing surfaces facing upward;

wherein the game table assembly includes stationary end sections positioned adjacent the width ends, wherein the table bed is rotatably engaged with and positioned between the end sections;

wherein the game table assembly includes four L-shaped corner brackets pivotally engaged with the end sections and selectively lockable to the table bed adjacent the four corners to selectively lock the table bed in the desired orientation with the desired one of the game playing surfaces facing upward and prevent rotation of the table bed;

wherein each of the corner brackets includes a first leg pivotally engaged with an end section and a second leg selectively lockable to the table bed;

wherein the second legs are selectively lockable to the table bed along the longitudinal sides thereof.

7. The game table assembly of claim 6, wherein the table bed defines depressions along the longitudinal sides thereof configured to receive the second legs of the brackets.

8. The game table assembly of claim 6, wherein each of the end sections defines two side cavities configured to receive the first legs of the corner brackets, the cavities being configured to allow for horizontal pivoting of the brackets within the cavities.

9. The game table assembly of claim 6, wherein each of the end sections includes spaced apart top and bottom portions and a back portion extending between the top and bottom portions, wherein the first leg of each of the corner brackets is configured to nest against the back portion snugly between the top and bottom portions in the engaged position.

10. The game table assembly of claim 6, further comprising four locking pins operable to selectively lock the corresponding corner brackets to the table bed in the engaged position, wherein each of the corner brackets defines a hole configured to receive the corresponding locking pin.

11. A game table assembly, comprising:

a rotatable game table having opposing longitudinal sides defining a length along a length axis and opposing width ends defining a width along a width axis, wherein the game table includes a first game playing surface for playing a first game and an opposite second game playing surface for playing a second game, wherein the game table is rotatable about the length axis to rotate between the first and second game playing surfaces to orient the desired one of the game playing surfaces facing upward;

wherein the game table includes a frame having first and second portions extending along at least a portion of the perimeter of the first and second game playing surfaces, respectively, and extending at least slightly beyond the first and second game playing surfaces, respectively, to prevent escape of game playing pieces from the game playing surfaces, wherein the frame includes a side railing portion positioned between the first and second portions;

opposing and non-rotatable end sections positioned adjacent the width ends, wherein the game table is positioned between and rotatably engaged with the end sections; and at least one corner bracket extending between one of the end sections and the game table, wherein the bracket is selectively positionable against the side railing portion along one of the longitudinal sides and selectively lockable thereto to lock the game table in the desired orientation with the desired one of the game playing surfaces facing upward and to prevent rotation of the game table;

wherein the at least one corner bracket is L-shaped with a first leg pivotally mounted to an end section and a second leg selectively lockable to the game table;

wherein the side railing portion is inset horizontally inward from the first and second portions of the frame and the second leg is positionable adjacent the side railing snugly between the first and second portions when the second leg is locked to the game table.

12. The game table assembly of claim 11, wherein the game table is rectangular in shape having four corners and the at least one corner bracket includes four corner brackets pivotally mounted to the end sections adjacent the four corners of the game table, wherein each of the brackets may be horizontally pivoted into and out of selective locking engagement with the game table to prevent rotation of the game table.

13. The game table assembly of claim 11, wherein the corresponding end section defines a cavity configured to receive the first leg of the corner bracket, the cavity being configured to allow for horizontal pivoting of the first leg.

14. A game table assembly, comprising:

a game table assembly having a rotatable table bed, the table bed being rectangular in shape and having four corners, opposing longitudinal sides defining a length along a length axis, and opposing width ends defining a width along a width axis, wherein the table bed includes a first game playing surface for playing a first game and an opposite second game playing surface for playing a second game, wherein the table bed is rotatable about the length axis to rotate between the first and second game playing surfaces to orient the desired one of the game playing surfaces facing upward;

wherein the game table assembly includes stationary end sections positioned adjacent the width ends, wherein the table bed is rotatably engaged with and positioned between the end sections;

wherein the game table assembly includes four L-shaped corner brackets pivotally engaged with the end sections and selectively lockable to the table bed adjacent the four corners to selectively lock the table bed in the desired orientation with the desired one of the game playing surfaces facing upward and prevent rotation of the table bed;

wherein each of the corner brackets includes a first leg pivotally engaged with an end section and a second leg selectively lockable to the table bed;

wherein the table bed includes a frame having first and second portions extending around the perimeter of the first and second game playing surfaces, respectively, and extending at least slightly beyond the first and second game playing surfaces, respectively, to prevent escape of game playing pieces from the game playing surfaces, wherein the frame includes a center side railing positioned between and inset horizontally inward from the first and second portions, wherein the second legs of the brackets are configured to nest into snug positions adjacent the center railing between the first and second portions when the second legs are engaged with the table bed.

* * * * *